US011367321B2

(12) United States Patent
Tartal et al.

(10) Patent No.: US 11,367,321 B2
(45) Date of Patent: Jun. 21, 2022

(54) LOCK

(71) Applicant: United States Postal Service, Washington, DC (US)

(72) Inventors: William Albert Tartal, Baltimore, MD (US); Gabriel Michael Yessin, Vienna, VA (US)

(73) Assignee: United States Postal Service, Washington, DC (US)

( * ) Notice: Subject to any disclaimer, the term of this patent is extended or adjusted under 35 U.S.C. 154(b) by 931 days.

(21) Appl. No.: 16/037,943

(22) Filed: Jul. 17, 2018

(65) Prior Publication Data

US 2019/0026968 A1 Jan. 24, 2019

Related U.S. Application Data

(60) Provisional application No. 62/534,323, filed on Jul. 19, 2017.

(51) Int. Cl.

| | |
|---|---|
| ***G07C 9/00*** | (2020.01) |
| ***E05B 65/02*** | (2006.01) |
| ***E05B 47/02*** | (2006.01) |
| ***E05B 77/48*** | (2014.01) |
| ***E05B 17/00*** | (2006.01) |
| ***E05B 47/00*** | (2006.01) |
| ***E05C 17/52*** | (2006.01) |

(52) U.S. Cl.

CPC ..... *G07C 9/00912* (2013.01); *E05B 47/026* (2013.01); *E05B 65/025* (2013.01); *E05B 77/48* (2013.01); *G07C 9/00944* (2013.01); *E05B 17/0037* (2013.01); *E05B 47/0004* (2013.01); *E05B 2047/0024* (2013.01); *E05B 2047/0094* (2013.01); *E05C 17/52* (2013.01); *G07C 2009/00769* (2013.01)

(58) Field of Classification Search

CPC ..... Y02T 10/40; F02D 41/345; F02D 41/045; F02B 3/06

USPC ..... 340/5.7; 292/144, 99, 201; 70/98, 280, 70/282

See application file for complete search history.

(56) References Cited

U.S. PATENT DOCUMENTS 3,890,608 A * 6/1975 Peterson ..... E05B 45/06 340/522
4,573,333 A * 3/1986 Choi ..... E05B 47/0002 292/18
4,579,376 A 4/1986 Charlton (Continued)

FOREIGN PATENT DOCUMENTS

EP 2876234 A1 5/2015

OTHER PUBLICATIONS

International Search Report & Written Opinion dated Sep. 26, 2018 in International Application No. PCT/US2018/042533 filed Jul. 17, 2018.

(Continued)

*Primary Examiner* — Nam V Nguyen

(74) *Attorney, Agent, or Firm* — Knobbe Martens Olson & Bear LLP

(57) ABSTRACT

Systems, devices, and methods of locking a lockable volume. The lock may comprise a bolt and a slider. The slider moves linearly to move the bolt in position to engage a securement feature. The engagement of the bolt with the securement feature secures the securement feature, thereby locking the door to which the securement feature is attached.

20 Claims, 10 Drawing Sheets

(56) References Cited

U.S. PATENT DOCUMENTS 4,648,253 A * 3/1987 Imhoff ..... E05B 47/0047 292/210
4,659,884 A * 4/1987 Wollenhaupt ..... E05B 47/0002 200/50.01
4,776,619 A * 10/1988 Daugherty ..... E05B 65/0811 292/108
4,913,475 A * 4/1990 Bushnell ..... E05B 47/026 292/144
5,113,676 A * 5/1992 Panossian ..... E05B 55/12 292/18
5,118,150 A * 6/1992 Jarrett ..... E05B 47/0047 292/341.16
5,531,086 A * 7/1996 Bryant ..... E05B 47/0012 292/142
5,690,373 A * 11/1997 Luker ..... E05B 63/0065 292/201
6,354,121 B1 * 3/2002 Frolov ..... E05B 47/0692 292/144
6,619,705 B2 * 9/2003 Dalsing ..... E05B 55/06 292/169.14
7,603,882 B2 * 10/2009 Carbajal ..... A47F 3/043 70/267
8,066,309 B2 * 11/2011 Bartos ..... E05C 1/163 292/337
10,233,673 B2 * 3/2019 Ramakrishna ..... E05B 63/06
10,263,400 B2 * 4/2019 Taaffe ..... H02B 1/26
10,704,305 B2 * 7/2020 Miyachi ..... E05B 47/0001
2005/0202178 A1 * 9/2005 Roche ..... C08G 18/283 427/385.5
2007/0152455 A1 * 7/2007 Ko ..... E05B 81/16 292/201
2014/0069154 A1 * 3/2014 Dolev ..... E05C 1/163 70/108

OTHER PUBLICATIONS

International Preliminary Report on Patentability dated Jan. 30, 2020 in International Application No. PCT/US2018/042533 filed Jul. 17, 2018.

* cited by examiner

LOCK

INCORPORATION BY REFERENCE TO ANY PRIORITY APPLICATIONS

Any and all applications for which a foreign or domestic priority claim is identified in the application data sheet as filed with the present application are hereby incorporated by reference under 37 C.F.R. 1.57.

BACKGROUND

Locks are frequently used to secure a door or lid on a lockable volume, such as a receptacle, and the locks can be remotely operated.

Figure 1:
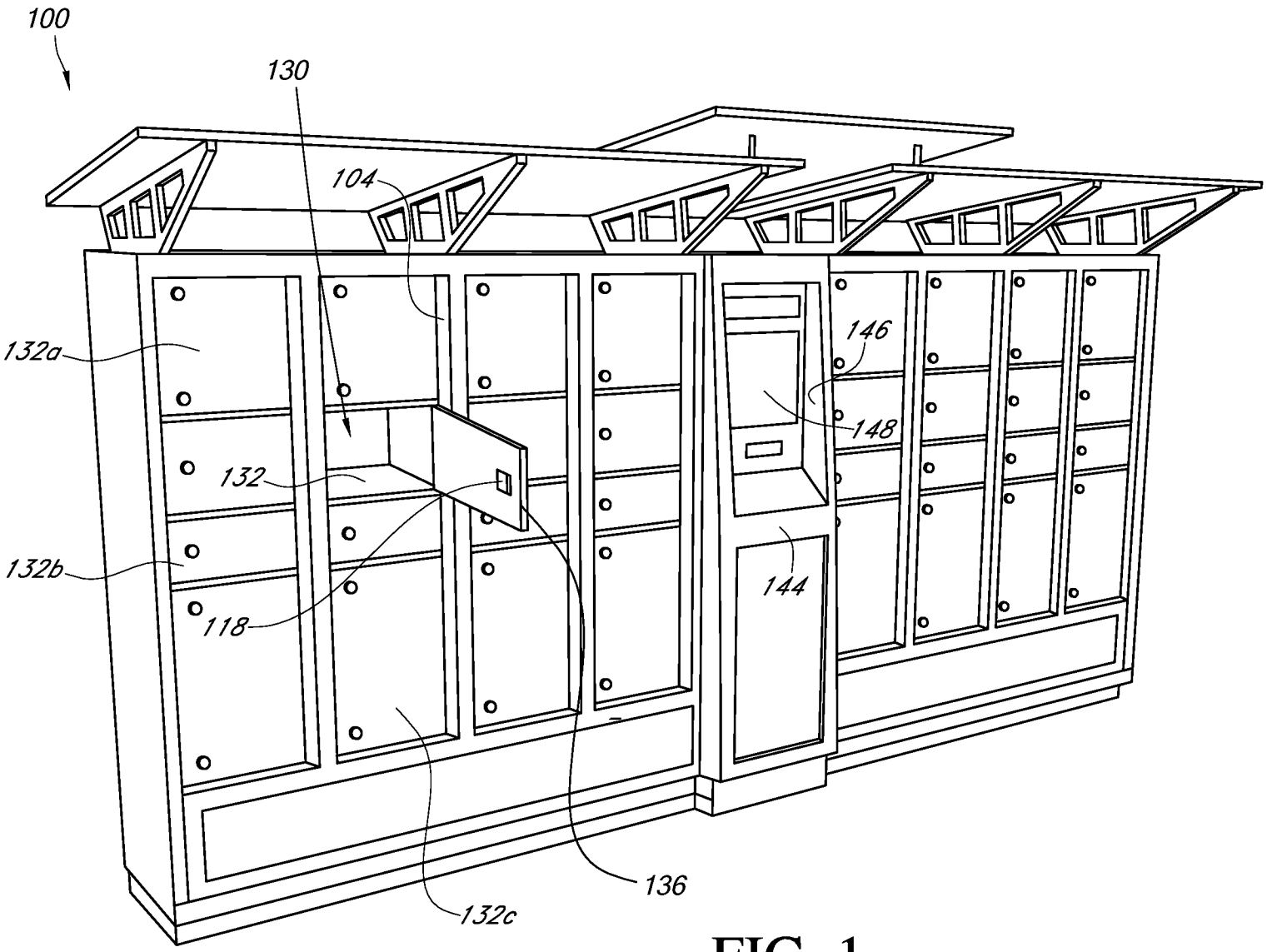
FIG. 1 is a perspective view of one embodiment of a storage unit with a plurality of storage receptacles.

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

SUMMARY

In one aspect described herein, a lock comprises a bolt movable along a first axis between a first locked position and a second unlocked position, the bolt having a first end and a second end; a pin in mechanical communication with the bolt; a slider movable along a second axis that is generally perpendicular to the first axis; an actuator connected to the slider that moves the slider along the second axis in response to a control signal; and wherein the slider is configured to contact the pin as the slider moves, thereby moving the bolt.

In some embodiments, the lock further comprises a spring, the spring disposed around an end of the bolt and in contact with the pin.

In some embodiments, the spring is biased to urge the bolt into the first locked position.

In some embodiments, the bolt comprises a slot formed therein, the slot extending along a portion of a length of the bolt between the first end and the second end of the bolt.

In some embodiments, the slider is configured to extend at least partially through the slot formed in the bolt.

In some embodiments, the slider comprises a first end portion, a central portion, and a second end portion, and wherein the slider comprises an inclined surface that extends from the first end portion to the central portion.

In some embodiments, the slider is connected to the actuator at the second end of the slider.

In some embodiments, the inclined surface of the slider contacts the pin.

In some embodiments, as the slider moves along the second axis, the pin moves along the inclined surface of the slider, thereby moving the bolt from the first locked position to the second, unlocked position.

In some embodiments, the slider comprises a first end and a second end and a central portion between the first and second ends, wherein the width of the slider at the first end and the second end are substantially the same width, and wherein the width of central portion of the slider is less than the width at the first end and the second end.

In some embodiments, the width of the slider narrows from the first end to the central portion of the slider.

In some embodiments, the central portion of the slider is disposed within the slot of the bolt.

In some embodiments, the pin is configured to contact the slider along the narrowing width as the slider moves.

In some embodiments, the second end of the bolt is tapered, and the second end of the bolt is configured to engage a securement feature.

In some embodiments, the securement feature is disposed on a door configured to move to provide access to a lockable volume.

In another aspect described herein, a locking system comprises a receptacle comprising by a plurality of surfaces and a door enclosing a lockable volume; a lock disposed proximate one of the plurality of surfaces, the lock comprising: a bolt movable along a first axis between a first locked position and a second unlocked position, the bolt having a first end and a second end; a pin in mechanical communication with the bolt; a slider movable along a second axis that is generally perpendicular to the first plane; an actuator connected to the slider that moves the slider along the second axis; a door moveable to allow access to the lockable volume, the door comprising a securement feature configured to interact with the first end of the bolt to lock the door when the bolt is in a first locked position.

In some embodiments, the securement feature comprises an extending portion having a cutout formed therein, and wherein the first end of the bolt is received in the cutout formed in the extending portion when the bolt is in the first locked position.

In some embodiments, the locking system further comprises a plunger mechanism disposed proximate one of the plurality of surfaces, the plunger mechanism comprising a rod and a spring, wherein the spring is biased to extend the rod.

In some embodiments, the rod is in contact with an inner surfaced of the door when the door is locked closed, and the spring is compressed when the door is locked closed.

In some embodiments, the spring is configured to urge the rod outward and push the door open when the door is unlocked.

DETAILED DESCRIPTION

In the following detailed description, reference is made to the accompanying drawings, which form a part hereof. In the drawings, similar symbols typically identify similar components, unless context dictates otherwise. Thus, in some embodiments, part numbers may be used for similar components in multiple figures, or part numbers may vary from figure to figure. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

The following detailed description is directed to certain specific embodiments of the development. Reference in this specification to "one embodiment," "an embodiment," or "in some embodiments" means that a particular feature, structure, or characteristic described in connection with the embodiment is included in at least one embodiment of the invention. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others. Similarly, various requirements are described which may be requirements for some embodiments but may not be requirements for other embodiments. Furthermore, embodiments of the development may include several novel features, no single one of which is solely responsible for its desirable attributes or which is essential to practicing the invention described herein.

Distribution items are increasingly being delivered to manned or unmanned areas having lockable volumes or receptacles for receiving the items, such as parcel locker installations. A delivery item can be any item which is delivered or picked up, such as a parcel, a package, an envelope, a flat, a mailpiece, a box, a suitcase, or any other item that can be transported from one location to another by a distribution entity. A distribution entity may be an entity engaged in transporting items from one location to another, such as the United States Postal Service (USPS), another commercial carrier, a storage facility, a fulfillment warehouse, a luggage sorting facility, or any other similar facility, company, or entity.

Items can be distributed to electronic lockers, such as electronic parcel lockers, which may be manned or unmanned. For example, a postal carrier or an item recipient can access the electronic parcel lockers to either deposit an item or to retrieve an item. These lockable volumes or receptacles are secured with locks. It can be advantageous to have a lock that is electronically actuated from a central location, such as a terminal or screen at the locker installation, rather than at the individual lock. In this way, a user can access one or more of the lockable volumes or receptacles without needing to have an individual physical key for the locks on the lockable volumes or receptacles. It can also be advantageous to have a lock on a lockable volume which does not have any components accessible from the exterior of the lockable volume to prevent damage to or unauthorized opening of the locks to access the contents of the lockable volume. It can also be advantageous to have a system which avoids reliance on customer compliance with keys, the management of keys, and possible damage to keys and/or locks.

Lock systems of the present disclosure can include a receptacle, a door, and a lock. In some embodiments, for example, the lock may be operated via a control unit. The control unit can be at the electronic locker installation. The control unit may include a user interface accessible on a terminal at the locker installation. In some embodiments, the control unit can be in electronic communication with a user interface that is remote from the locker installation, such as an application running on a mobile computing device.

The control unit can be configured to send a signal to the lock upon request from a user or the system in which the lockable volume is contained. In some embodiments, the lockable volume may be unlocked and the user or system requests that the lockable volume be locked. In some embodiments, the lockable volume may be locked and the user or system requests that the lockable volume be unlocked.

The lock secures the door of a lockable volume. Upon unlocking, the door may automatically open slightly. The user may manually open the door to gain access to the lockable volume. The lock shape and configuration may make it easier to place a majority of the lock in a position inaccessible to a user, increase usable space in the lockable volume, and/or decrease space between lockable volumes in a storage unit.

Although a specific example of a storage unit is described herein, this is not limiting. The aspects described can be used to control access to a variety of lockable volumes, including for example but not limited to, boxes, drawers, safes, containers, cabinets, and the like. Although a specific example of a swinging door is described a sliding door, lid, drawer, or a combination can be used, such that access to an lockable volume or receptacle is controlled.

FIG. 1 depicts one embodiment of a storage unit having one or more lockable volumes or storage receptacles. A storage unit 100 has a plurality of storage receptacles 132. The storage receptacle 132 has a plurality of sides 134 and a door 136. The combination of the sides 134 and the door 136 defines a lockable volume 130. The lockable volume 130 can receive an item in the internal volume of the lockable volume 130, for example, a parcel or a package. The lockable volume 130 may have a variety of shapes and sizes, and may be made from a variety of materials and/or components.

The storage unit 100 has a plurality of storage receptacles 132*a-c*, which may be of the same size, or which may be of different sizes. Thus, as depicted in FIG. 1, the storage unit 100 includes a first storage receptacle 132*a*, a second storage receptacle 132*b*, and a third storage receptacle 132*c*. The second storage receptacle 132*b* is smaller than the first storage receptacle 132*a*. The third storage receptacle 132*c* is larger than the first storage receptacle 132*a*. In some embodiments, the storage unit 100 may have storage receptacles 132*a-c* that are all the same size. A person of skill in the art will recognize that the present disclosure is not limited to any specific form of lockable volume, but broadly encompasses any lockable volume.

A lock 102 is disposed on one of the plurality of sides 134 or on the door 136 of one of the receptacles 132*a-c*. As depicted, the lock 102 is disposed on one of the plurality of sides 134 of the storage receptacle 132. The lock 102 will be described in greater detail below.

In some embodiments, the lock 102 is configured for remote operation. Specifically, in some embodiments, the lock 102 is controllable in response to received signals, such as, for example, electric, light, optical, radio, or any other signal. The received signals may come from a control unit 144 including a controller. In some embodiments, the control unit includes a terminal 146 having a user interface 148. In some embodiments, the user interface 148 can be located or operational on a mobile computing device in electronic communication with the control unit 144. In some embodiments, the control unit 144 can be in communication with the user interface 148 of the terminal 146, and can also be in communication with a remote user interface 148.

In some embodiments, for example, the lock 102 is controllably disengaged so as to allow access to the lockable volume 130. In some embodiments, the lock 102 may be controllably disengaged so as to allow a user access to the lockable volume 130. The user may input data into the control unit 144 in order to gain access to one or more storage receptacles 132, as depicted in FIG. 1. This access process can be similar to that described in U.S. application Ser. No. 13/706,281, filed Dec. 5, 2012, the entire contents of which are hereby incorporated by reference.

The door 136 of the storage receptacle 132 is moveably connected to one of the plurality of sides 134 in order to define the lockable volume 130. In some embodiments, the door 136 of the storage receptacle 132 may be movably connected to the storage unit 100. The door 136 is moveably connected so as to allow rotation of the door 136, a sliding movement of the door 136, or any other desired movement of the door 136 relative to the plurality of sides 134 and the lockable volume 130. As depicted in FIG. 1, the door 136 is rotationally connected to one of the walls 134. The door 136 may be connected with a wall 134 via one or more hinges. In some embodiments, the door 136 can be connected to a support member 104 of the storage receptacle 100 and can align with the opening bounded by the walls 134. The hinged connection allows the door 136 to move between a closed position and an open position. When the door 136 is in the closed position, the lockable volume 130 is inaccessible. When the door 136 is in the open position, the lockable volume 130 is accessible. As depicted in FIG. 1, the connection of the door 136 to one of the walls 134 allows rotational displacement of the door 136 relative to the lockable volume 130 and the storage unit 100.

In some embodiments, the door 136 may be slidable by a track or similar device. This type of connection allows for the door 136 to slide between an open position and a closed position. Although this embodiment is not specifically depicted, a person of skill in the art would understand, using the present disclosure as a guide, how to provide a sliding door on a storage unit 100 described herein.

The storage receptacle 132 has features that secure the door 136 in the closed position. These features may include, for example, a lock 102 and a securement feature 118. The securement feature 118 may be located in any desired position relative to the lockable volume 130. The securement feature 118 matingly interacts with the lock 102 to secure the door 136 in the closed position, and will be described in greater detail herein.

Figure 2:
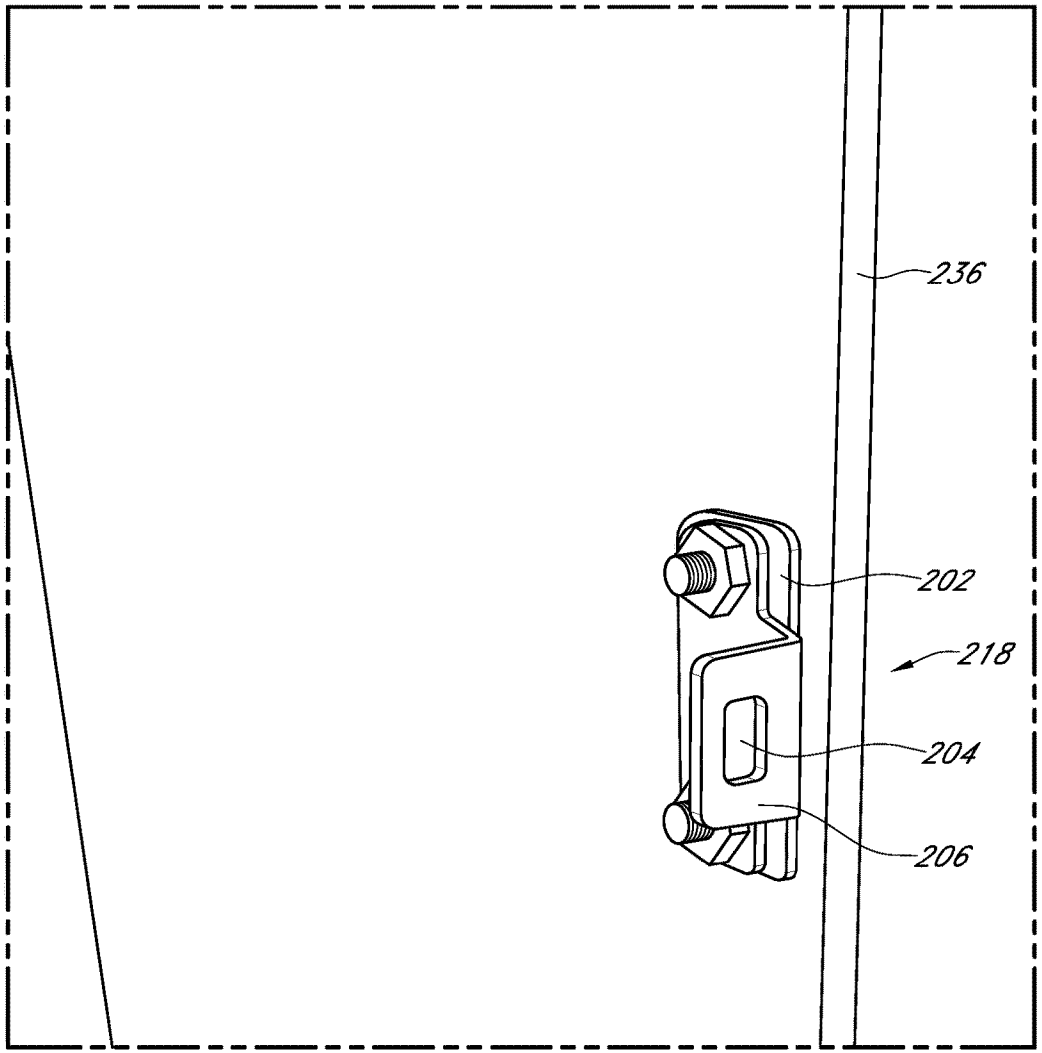
FIG. 2 is a perspective view of one embodiment of a securement feature on a door of a receptacle.

FIG. 2 shows an embodiment of a securement feature 218 located on an inside surface of a door 236. As will be described elsewhere herein, the securement feature 218 interacts with features of the lock (not shown) to secure the door 236 in a closed position. The securement feature 218 has a base portion 202 that is fixedly attached to the door 236. As shown, the base portion 202 extends in a plane parallel to the plane of the door 236, and has a surface which contacts an inner face of the door 236. The securement feature 218 has an extending portion 206 with a cutout 204 formed therein. The extending portion 206 extends perpendicularly away from the inside surface of the door 236. The securement feature 218 is shaped such that it interacts with a portion of the lock which extends through the cutout 204 when the door 236 when the door is closed. The portion of the lock which extends through the cutout prevents movement of the door 236. This will be described in greater detail below.

In some embodiments, the securement feature 218 may have a hooked or curved end which is configured to interact with a portion of the lock. The securement feature 218 may have a variety of shapes and sizes, and may be made of a variety of materials corresponding to a complementary feature on the lock (not shown), which will be described below. In some embodiments, for example, the size, shape, and materials of the securement feature 218 may be designed to securely maintain the door 136 in a closed position. In some embodiments, such a design requires selecting a size, shape, and/or materials for the securement feature 218 such that the securement feature 218 can resist forces applied to the securement feature 218 if an attempt is made to forcibly open the door 236. In some embodiments, the securement feature 218 is integral with the door 236.

The lock (not shown) engages with the cutout 204 of the securement feature 218 to limit movement of the door 236. The lock disengages from cutout 204 of the securement feature 218 to allow the door 236 to open. In some embodiments, the securement feature 218 may have any suitable shape that is able to interact with the lock 202. In some embodiments, the lock may have components and/or a mechanism interacting together to selectively allow the engagement and/or disengagement of the securement feature 218. In some embodiments, the securement feature may not have a cutout 204, but may have a curve or hooked portion that is configured to interact with a portion of the lock.

As illustrated in FIG. 2, the securement feature 218 is located on the inside of the free end of the door 236, or, in other words, along the edge of the door 136 which is not proximate one of the walls of the receptacle when the door 236 is open.

Figure 3:
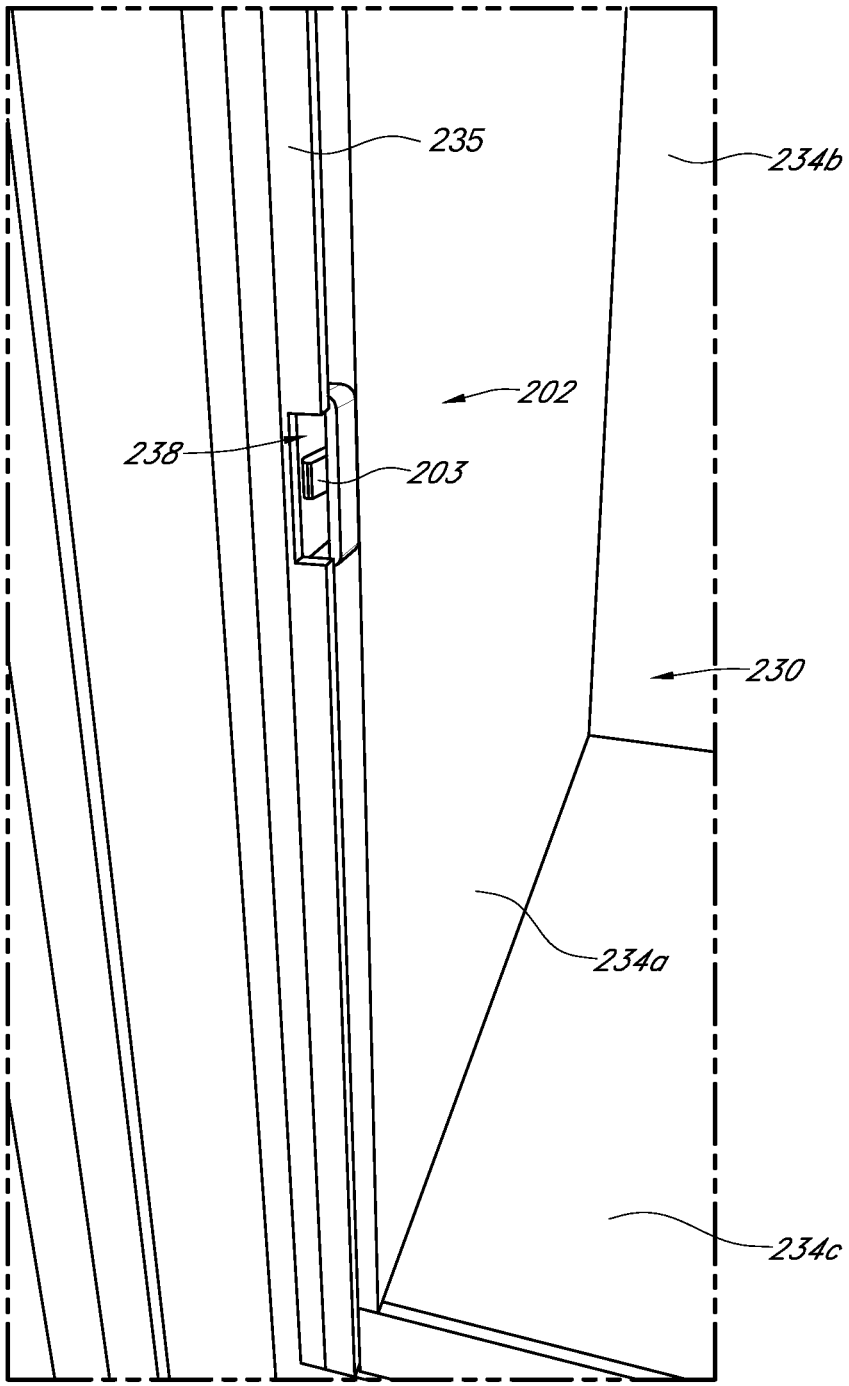
FIG. 3 is a perspective view of the inside of a storage receptacle.

FIG. 3 illustrates one embodiment of a storage receptacle 232 with three walls 234*a*, 234*b*, and 234*c* visible. Wall 234*a* is the left sidewall, wall 234*b* is the back wall, and wall 234*c* is the bottom. Along with walls 234*a*, 234*b*, 234*c*, there are the top and the right sidewalls (not shown) that define a portion of a lockable volume 230. As depicted in FIG. 3, the sidewall 234*a* separates the internal volume from the components of a lock 202. The lock 202 comprises a bolt 203.

In some embodiments, the lock 202 and its components may be positioned within the internal volume 230. In some embodiments, the lock 202 may be positioned on the door 236 and the securement feature 218 may be positioned in or adjacent to the lockable volume 230. In some embodiments, the lock 202 may be located near another wall, for example, the right sidewall, bottom, or top.

An opening 238 can be formed in a seat 235 which extends around an edge of the walls 234*a-c* (and those not shown). The opening 238 is sized and shaped to receive the extending portion 206 of the securement feature 218 as the door 236 is closed. The securement feature 218, and specifically the extending portion 206 moves into the opening 238 as the door 236 is closed. The cutout 204 of the securement feature 218 interacts with a the bolt 203 when the bolt 203 is in a first position. The securement feature 218 moves freely past the bolt 203 when the bolt 203 is in a second position. As the door 236 closes, the extending portion 206 of the securement feature 218 moves into opening 238. The extending portion 206 may press on the bolt 203 and move the bolt 203 against a spring force. As such, when the cutout 204 moves toward the end of the bolt 203, the bolt 203, under urging from a spring force, can return to a raised position and a portion of the bolt 203 will extend into the cutout 204 in portion 206. When the portion of the bolt 203 extends into the cutout 204, the securement feature 218 is restricted from moving out of the opening 238 and the door 236 is secured in the closed position. This process will be described in greater detail below.

Figure 4A:
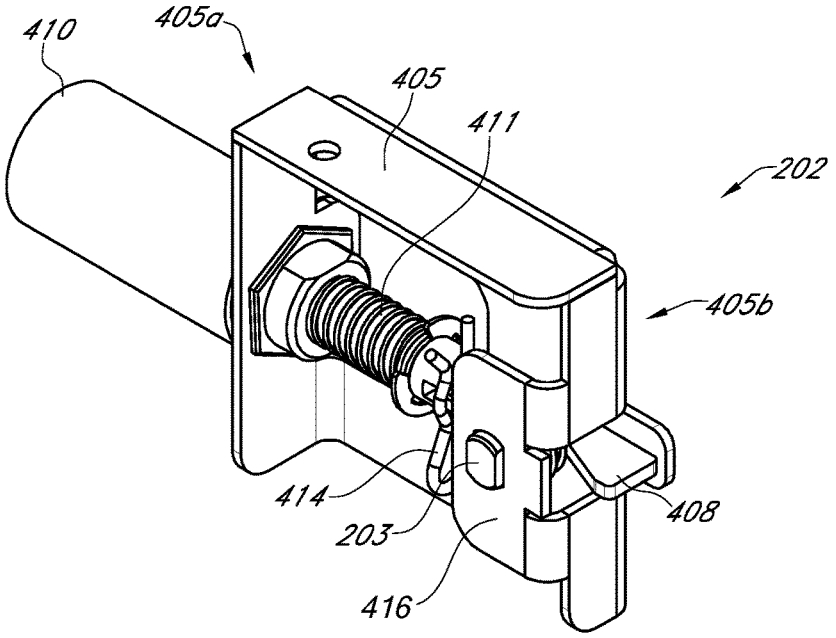
FIG. 4A is a rear perspective view of one embodiment of a lock assembly.
Figure 4B:
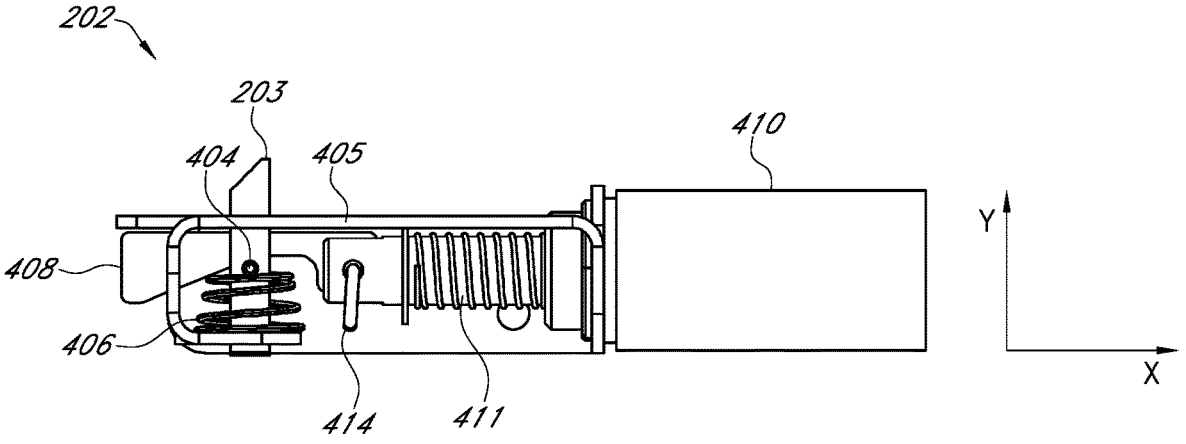
FIG. 4B is a side view of the lock assembly of FIG. 4A.
Figure 4C:
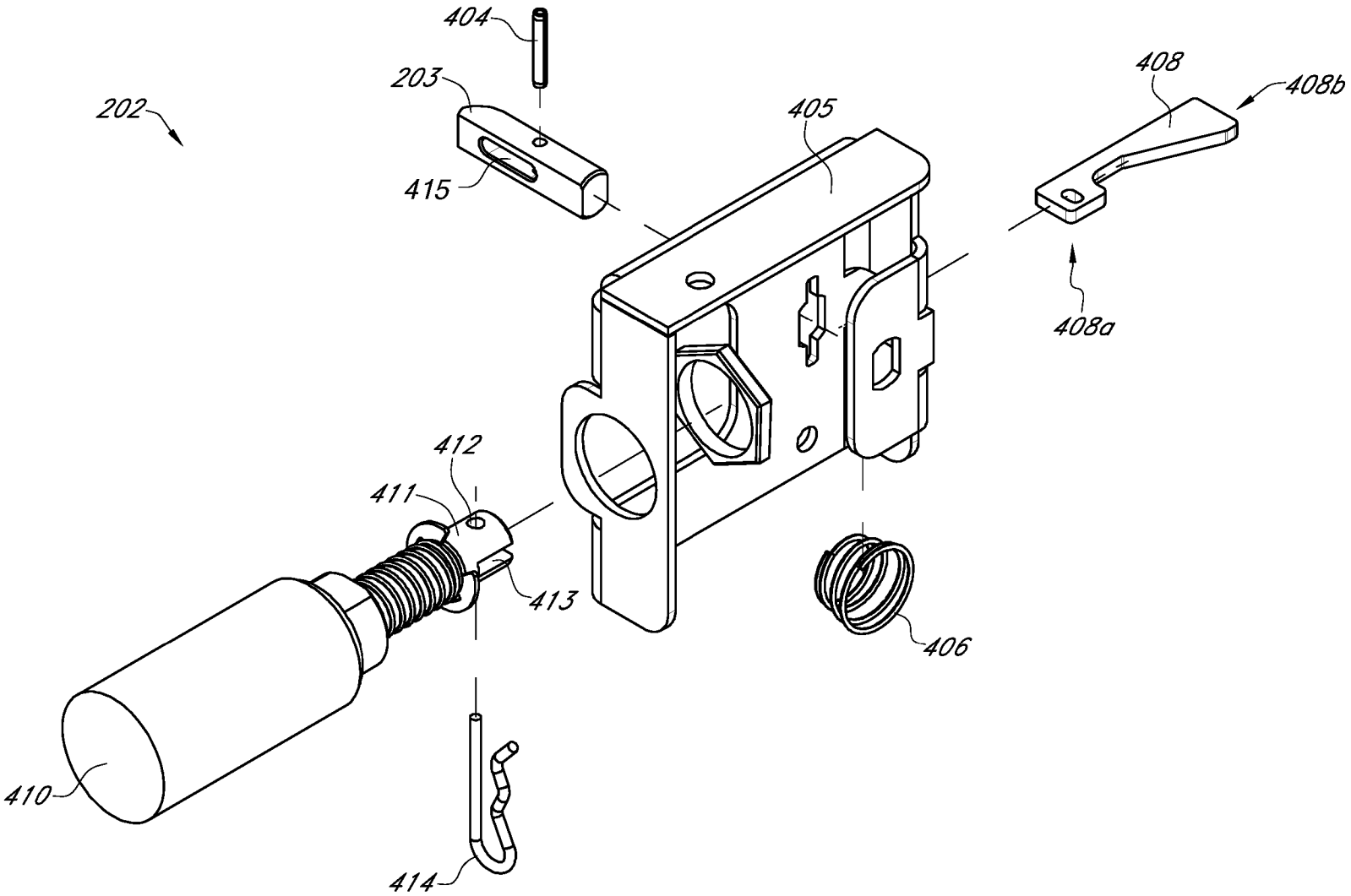
FIG. 4C is an exploded view of the lock assembly of FIG. 4A.

FIGS. 4A, 4B, and 4C depict an embodiment of the lock 202. The lock 202 is disposed proximate a structural member or component of the storage unit, or disposed or enclosed within a structural member such that most of the components of the lock 102 are hidden from view, even when the storage receptacle 132 is open. Additionally, most of the components of the lock 102 are not accessible when the door 136 is open.

FIG. 4A is a rear view of the lock 202. The lock 202 comprises a frame 405, the bolt 203, a spring 406, a slider 408, and an actuator 410. The frame 405 is a rigid structure to which several components of the lock 202 are attached or affixed to provide structural stability and to place the components of the lock 202 within the proper physical relationship to one another. The frame comprises a cover 416. The frame 405 and the cover 416 include holes formed therein to receive portions of the bolt 203, as will be described in greater detail below.

The actuator 410 is attached to the frame 405 on a first end 405*a*. The actuator 410 is an electromechanical device, such as a solenoid, motor, piston, pneumatic cylinder, or other similar device capable of converting a control signal into a mechanical force to operate on components of the lock 202. The actuator 410 is connected to an electrical power supply and can receive a control signal from a processor in the control unit (not shown). The actuator 410 comprises a shaft 411. In some embodiments, the actuator 410 can include a spring or resilient member which returns the shaft 411 to its original position after actuation.

The shaft 411 includes a connection hole 412 and a connection notch 413 to receive a first end 408*a* of the slider 408. The first end 408*a* of the slider 408 includes a hole 409. The first end 408*a* is disposed within the notch 413 such that holes 409 and 412 align. A pin 414 is inserted into the aligned holes 409 and 412 to retain the slider 408 within the notch 413. As depicted in FIG. 4B, the slider 408 is connected to the actuator 410 by the pin 414. The pin 414 may be, for example, a cotter pin, screw, interference fit, spring pin, slot pin, R-clip, or the like. In some embodiments, the slider 408 and actuator 410 may be connected by any suitable means. In some embodiments, the slider 408 may be integrally formed with the shaft 411 of the actuator 410.

The actuator 410 moves the slider 408 in a generally linear direction. In some embodiments, the actuator 410 may be a linear actuator, for example, solenoid, hydraulic, pneumatic, electro-mechanical, or the like. The actuator 410 may be a solenoid type transducer that converts energy into linear motion. In some embodiments, the actuator 410 may be one-directional. For example, if the actuator 410 is one-directional, the actuator 410 may pull the slider 408 to the right, lowering the bolt 203. In those instances, the bolt 203 may move to a raised position due to the force exerted by the spring 406. In some embodiments, the actuator may be one-directional and push the slider to the left, raising the bolt 203. In some embodiments, the actuator 410 may be two-directional or a push-pull type. For example, if the actuator 410 is two-directional, the actuator 410 may pull the slider 408 to the right and push the slider 408 to the left, lowering and raising the bolt. In some embodiments, a controller may control the actuator 410.

The second end 408*b* of the slider 408 extends proximate the second end 405*b* of the frame 405. The bolt 203 has a slot 415 formed therein. The slot 415 is sized and shaped to receive a portion of the slider 408. The slider 408 extends through the bolt 203 in a direction perpendicular to the length of the bolt 203.

As depicted in FIG. 4B, a spring 406 is positioned around an end of the bolt 203. The spring 406 is biased and positioned to move the bolt 203 to a first extended position. In some embodiments, the spring 406 may be biased in the opposite direction. The spring 406 contacts the cover 416. The spring 406 may be connected to the cover 416 by any suitable means. In some embodiments, there is no cover 416. In some embodiments, the spring 406 contacts a wall of the lockable volume 230. The spring 406 interacts with the pin 404 that extends through the bolt 203. In some embodiments, the bolt 203 may be shaped so that the spring 406 interacts with a surface of the bolt 203. In some embodiments, any suitable elastic or resilient material/structure can be used for the spring 406.

The slider 408 moves generally in the X-direction (left and right), whereas the bolt 203 moves generally in the Y-direction (up and down). The movement of the slider 408 is generally linear. The movement of the bolt 203 is generally linear. The bolt 203 moves between first and second positions according to forces applied to it by the slider 408, as will be described below.

Figure 5A:
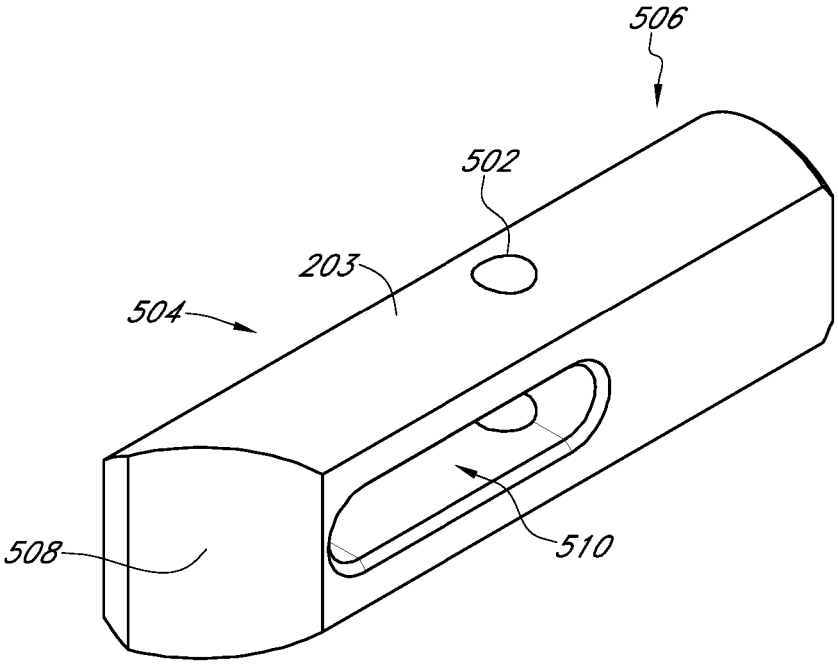
FIG. 5A is a front perspective view of one embodiment of a bolt of the lock assembly.
Figure 5B:
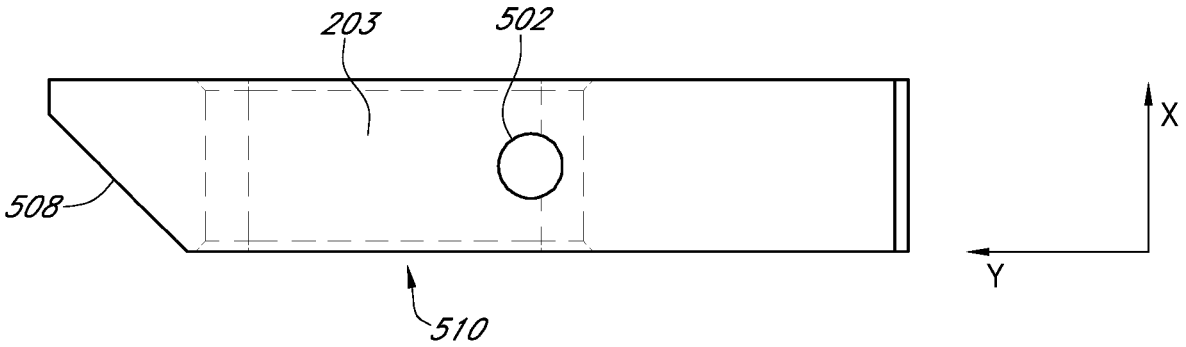
FIG. 5B is a side view of the bolt of FIG. 5A.

FIG. 5A is a front perspective view of the bolt 203. The bolt 203 has a first end 504 and a second end 506. The upper portion of the bolt 203 has an inclined surface 508. The inclined surface 508 interacts with the securement feature 218. The securement feature 218 may contact the inclined surface 508 and push the bolt 203 down. As depicted in FIG. 5B, the bolt 203 moves generally in the Y-direction and the securement feature 218 would move generally in the X-direction, which correspond to the X- and Y-directions in FIG. 4B.

As depicted in FIGS. 5A and 5B the bolt 203 has a hole 502, through which the pin 404 may extend. As shown, the hole 502 extends into the page. The pin 404 may be a spring pin, a cotter pin, screw, interference fit, slot pin, R-clip, or the like. In some embodiments, pin 404 and the bolt 203 are integrally formed. The pin 404 can mechanically interact with or contact the spring 406. The spring 406 is configured to move the bolt 203 by exerting a force on the pin 404. The spring 406 is biased so that it pushes on pin 404. In some embodiments, where the bolt 203 is shaped to interact with the spring 406, the spring 406 exerts a force on a surface of the bolt 203.

The bolt 203 has a slot 510 formed therein. The slot 510 is sized and shaped to receive at least a portion of the slider therein. In some embodiments, the slider 408 is disposed partially within the slot 510, such that a central portion of the slider 408 is disposed within the slot, and the first and second ends 408*a-b* of the slider 408 extend beyond the slot 510. The slot 510 extends through the bolt 203 in generally the X-direction (front-to-back). In some embodiments, the slider 408 may have a hole that the bolt 203 extends through. As depicted in FIG. 5B, the slider would move generally in the X-direction, which corresponds to the X-direction in FIG. 4B. The bolt 203 may be made from any suitable materials.

Figure 6A:
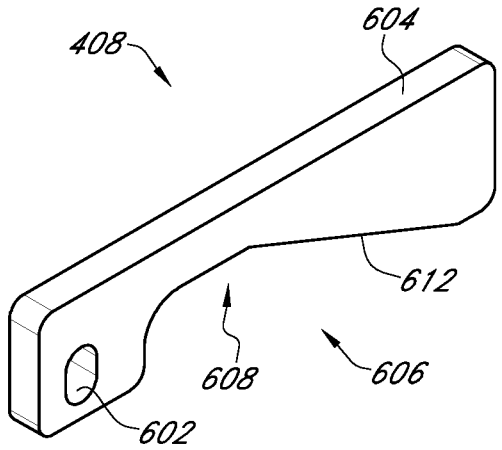
FIG. 6A is a perspective view of one embodiment of a slider of the lock assembly.
Figure 6B:
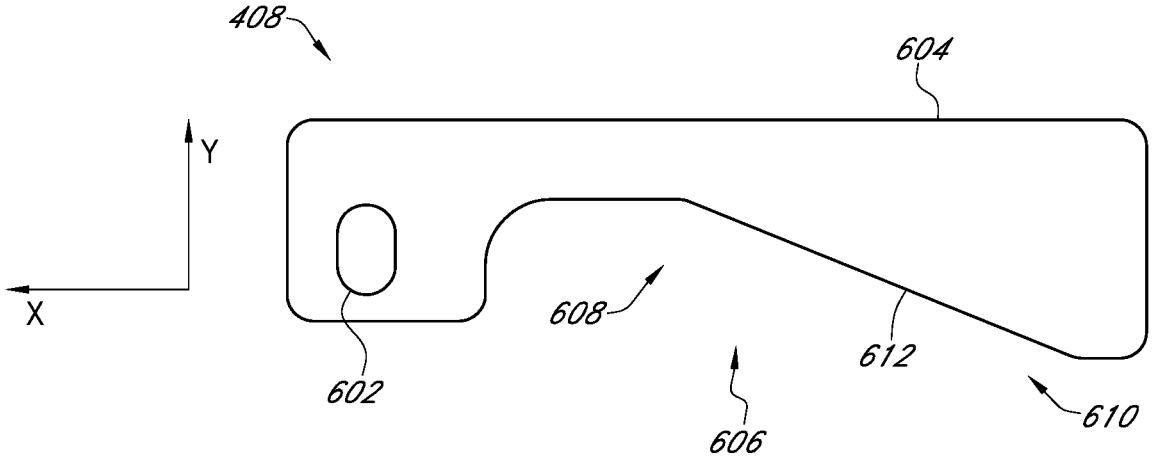
FIG. 6B is a side view of the slider of FIG. 6A.

FIG. 6A is a perspective view of the slider 408. FIG. 6B is a side view of the slider 408. The X- and Y-directions correspond to the directions in FIG. 4B. The slider 408 moves generally in the X-direction. The hole 602 is used to receive the pin 414 to connect the slider 408 to the actuator 410, as described elsewhere herein. The slider 408 has a top surface 604 and a bottom surface 606.

The top surface 604 is a generally straight or flat surface and extends substantially within a plane from the first end 408*a* to the second end 408*b*. The bottom surface 606 extends in variable directions, and includes an incline portion 612. The thickness distance from the top surface 604 to the bottom surface 608 varies over the length of the slider 408, that is, from the first end 408*a* to the second end 408*b*.

When the slider 408 is disposed through the bolt 203, as shown in FIGS. 4A-4C, the pin 404 contacts the bottom surface 606 and is configured to move along the bottom surface of the slider 408 as the slider 408 moves. The spring 406 applies a force to the pin 404 which urges the pin 404 to remain in contact with the bottom surface 606 of the slider 408. In some embodiments, the inclined portion 612 can be at an angle less than 90 degrees relative to the top surface 604. In some embodiments, the inclined portion 612 can be at an angle of 22 degrees relative to the top surface. A person of skill in the art, guided by this disclosure, will understand that the angle of the inclined portion can be of any desired angle.

Figure 7A:
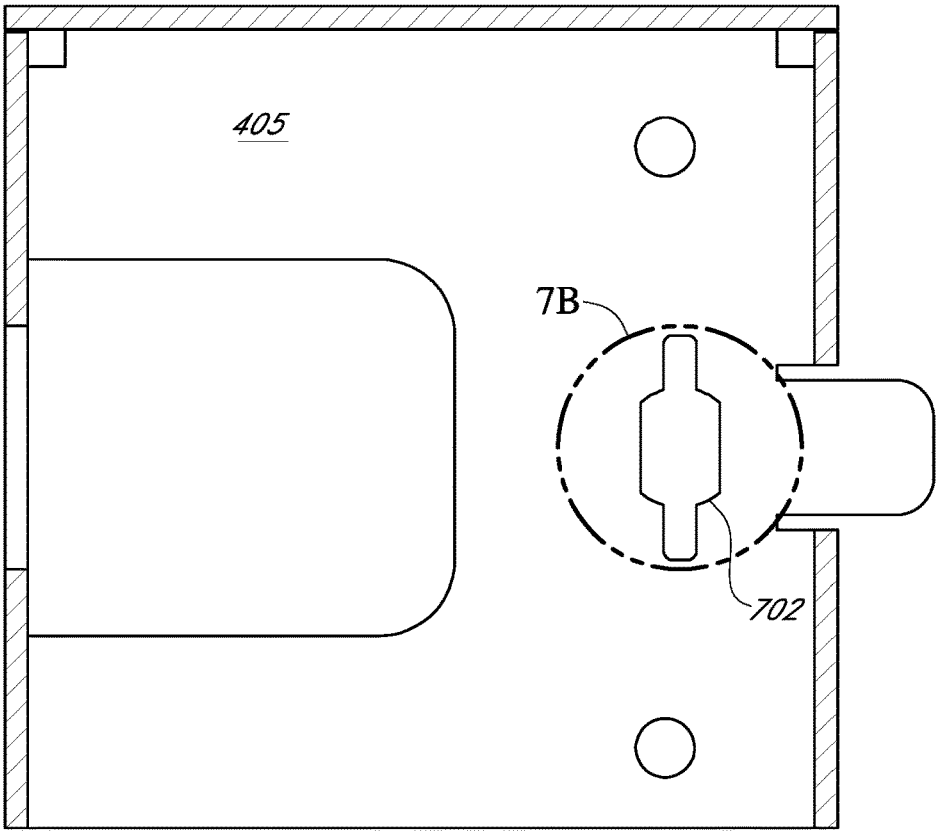
FIG. 7A is a top view of one embodiment of a cover of the lock assembly.
Figure 7B:
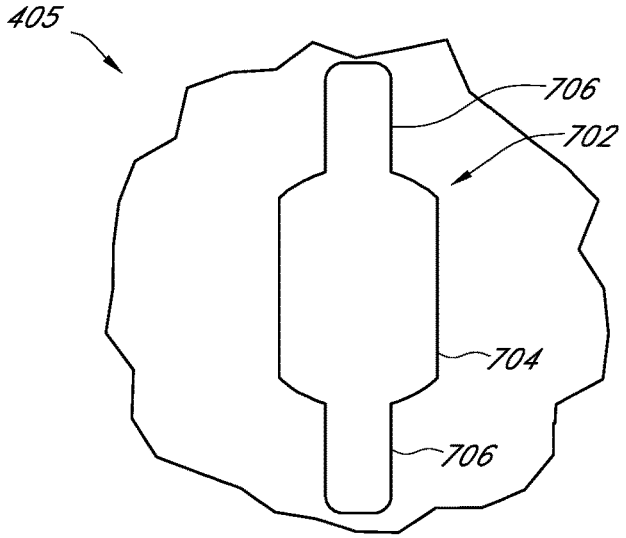
FIG. 7B is a detail view of the cover of FIG. 7A taken along line 7B-7B.

FIGS. 7A and 7B depict one embodiment of the cover 416. FIG. 7A is a cross-sectional view of the cover 416 showing a cutout 702. FIG. 7B is a detail view of a cutout 702 in the top surface of the cover 416. The bolt 203 travels through the cutout 702. The main portion 704 of the cutout 702 is shaped so that the bolt 203 can freely travel through. The end portions 706 are shaped so that the pin 404 can freely travel through the cutout. The cover 416 may help guide the bolt 203 as it moves between raised and lowered positions. The cover 416 may help secure the bolt 203 in the raised position. The cover 416 may help guide the slider 408 as it moves. The cover 416 may help secure the spring 406. The cover 416 may help secure the actuator 410.

The slider 408 interacts with the pin 404 to move the bolt 402. In some embodiments, the bolt 402 may be shaped so that the slider interacts with a surface of the bolt 402. The slider 408 moves generally in the X-direction and the bolt 402 moves generally in the Y-direction. As depicted in FIG. 4B, the spring 406 exerts a force on the pin 404 in the positive Y-direction (upwards). The pin 404 contacts the slider 408, which limits the bolt's motion in the Y-direction. As the slider 408 is pulled in the positive X-direction (to the right) by the actuator 410, the slider 408 pushes on the pin 404 and lowers the bolt 402. The force exerted by slider 408 on the pin 404 opposes the force exerted by the spring 406. The bottom surface 606 of the slider 408, as depicted in FIG. 6B, limits the displacement of the spring 406. In some embodiments, the slider 408 may contact the spring 406. The pin 404 contacts the bottom surface 606 of the slider 408, which restricts the motion of the pin 404 in the Y-direction. The bottom surface 606 of the slider 408 may push on the pin 404, compressing the spring 406 and lowering the bolt 402.

Operation of the lock 200 will now be described with reference to FIGS. 4A-7B. With the door 236 in a closed position, the securement feature 218 is disposed within the opening 238. The slanted portion 508 of the bolt 203 is extended into the cutout 204 such that the bolt is secured in the cutout 204, thus preventing opening of the door 236.

A user wishing to open one of the lockers secured by the lock 200 can provide an access request at a user interface at the locker or on a mobile device. The control unit can verify an access request and send an open signal to the lock 200. The actuator 210 receives a signal to open the locker. The actuator 210 moves in a first direction. As the actuator 210 moves in the first direction, the slider 408, which is connected to the actuator 210 moves in the first direction as well. In some embodiments, the shaft 211 of the actuator moves toward the body of the actuator in a direction along the X axis, to the right, as depicted in FIG. 4B.

The actuator 408 moves within the slot 510 of the bolt 203. As the slider 408 retracts, the inclined portion 612 moves, applying a force to the pin 404. As the slider 408 moves, the pin 404 slides along the inclined portion in a direction away from the top surface 604 of the slider 408. This applies a downward force on the pin 404, which in turn, imparts a force on the bold 203. The bolt moves to a second, retracted position, compressing the spring 406. As the bolt 203 moves and retracts, the slanted end 508 moves out of the cutout 204 of the securement feature 218, thus freeing the door 236 for operation.

After the door is opened, the actuator releases or moves back to its initial position, and the process of moving the bolt 203 is reversed, and the bolt re-extends into the first position. In some embodiments, the actuator may remain in the second position, with the door unlocked, until a signal is sent to lock the receptacle, at which point the actuator moves to relock the door 236.

As the door is closed after an item has been deposited, removed, or after another transaction has occurred, the bolt 203 may be in the extended, first position. AS the door closes, the extending portion 206 of the securement feature 218 contacts the slanted end 508 of the bolt 203. The extending portion 206 slides along the slanted end 508, and imparts a force on the bolt 203 which compresses the spring 406. When the extending portion 206 has advanced sufficiently as the door 236 is closed, the cutout 204 is proximate the slanted end 508. The bolt 203, no longer in physical contact with the extending portion 206 returns to its first extended position due to the force of the spring 406. The slanted portion 508 then is extended into the cutout 204, and the door 236 is securely locked.

Figure 8:
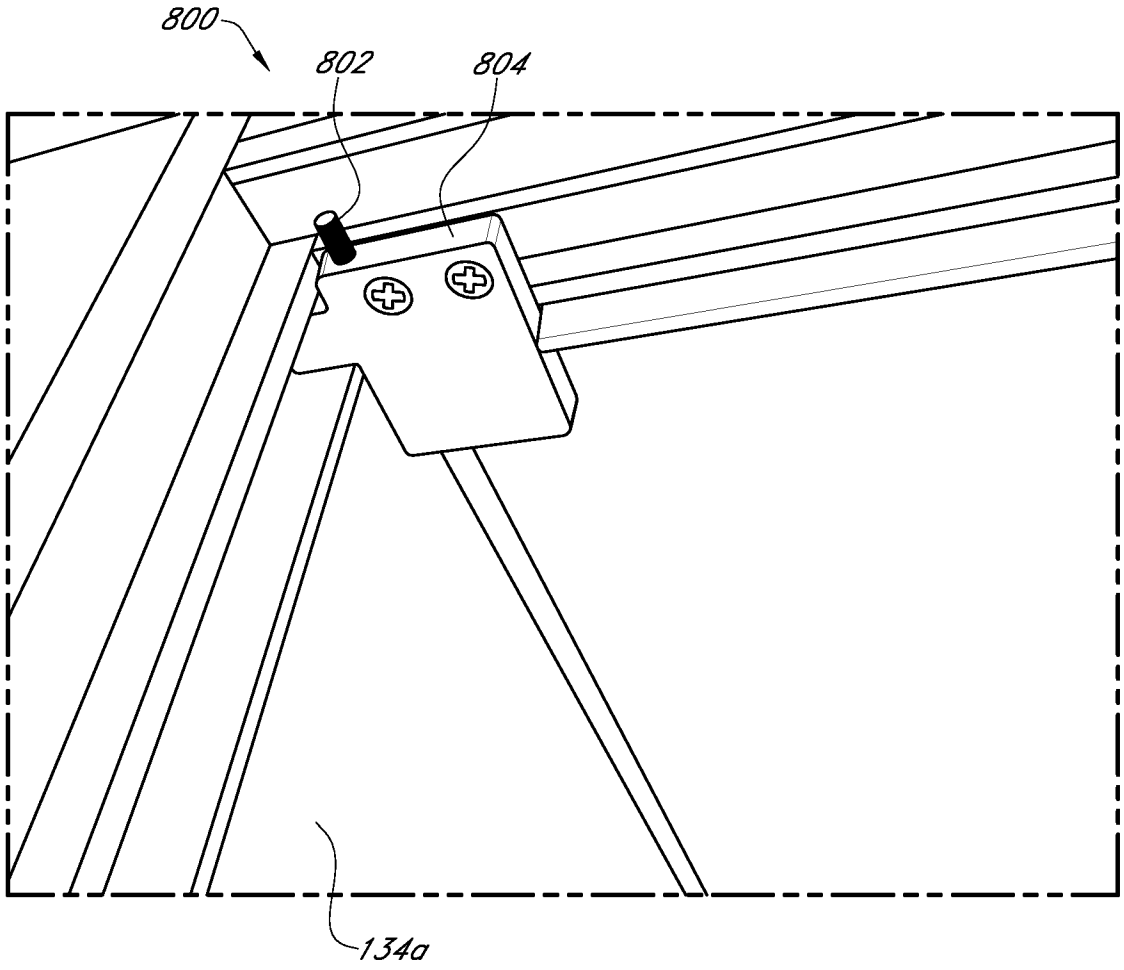
FIG. 8 is a perspective view of one embodiment of a plunger mechanism positioned inside a storage receptacle.

FIG. 8 depicts an embodiment of a plunger mechanism 800. In some embodiments, the locker 200 have include a plunger mechanism 800 to urge the door open when the lock 202 is unlocked. In some embodiments, the plunger mechanism 800 can provide a signal to a detection circuit (not shown) which provides a signal that the door is open or closed. For example, the plunger mechanism 800 can cause the door 236 pop open when the bolt 203 is withdrawn from the cutout 204, as described herein. As depicted, the plunger mechanism 800 is located inside the receptacle. In some embodiments, the plunger mechanism 800 may be incorporated with a portion of one of the plurality of storage receptacles.

As depicted in FIG. 8, the plunger mechanism 800 has a rod 802 and a housing 804. Inside the housing 804 is a spring (not shown). The spring (not shown) is biased to exert a force on the rod 802 in a direction such that the rod extends out of the housing. In some embodiments, the cross-section of the rod 802 can have any suitable shape and is not limited to a round cross-section. In some embodiments, inside the housing 804 is a circuit having components in connection with the rod 802. The rod 802 can be part of a microswitch.

As the rod 802 is moved, the circuit can detect the rod movement, or the rod's change of position. The movement of the rod 802 can complete a circuit, open a circuit, or otherwise signal that the door has changed state. For example, when the rod 802 is compressed by the door 236, the rod 802 can complete a circuit which sends a signal to the control unit that the door is closed. Similarly, when the door is opened, the rod 802 extends under the spring force, and opens the circuit. The open circuit can generate a door open status signal to the control unit.

When the door 236 is closed, the inside surface of the door 236 contacts the rod 802 and pushes the rod in against a spring force. The lock 202 prevents the spring force in the plunger mechanism from pushing the door open. In some embodiments, the plunger mechanism 800 may be located on the door and the rod 802 contacts a surface of the storage receptacle 132 or storage unit 100. The user pushes the door 236 closed and overcomes the force of the spring on the rod 802. The rod 802 is pushed into the housing 804 so that the door 236 can shut completely. When the lock 202 is engaged, movement of the door 236 is restricted. When the lock 102 is disengaged, as described herein, the spring force pushes the rod 802 outward, and the force from the rod 802 moves the door 236. In some embodiments, this may cause the door to spring fully open. In some embodiments, the door 236 may open only slightly, and may remain ajar as the inner surface of the door 236 contacts the extended rod 802.

In some embodiments, an actuator in communication with the control unit, may control the movement of the rod 802. In some embodiments, the plunger mechanism 800 may be configured for remote operation. Specifically, in some embodiments, the plunger mechanism 800 is controllable in response to received signals, such as, for example, electric, light, optical, radio, or any other signal. The received signals may come from a control unit 144 including a controller.

Figure 9:
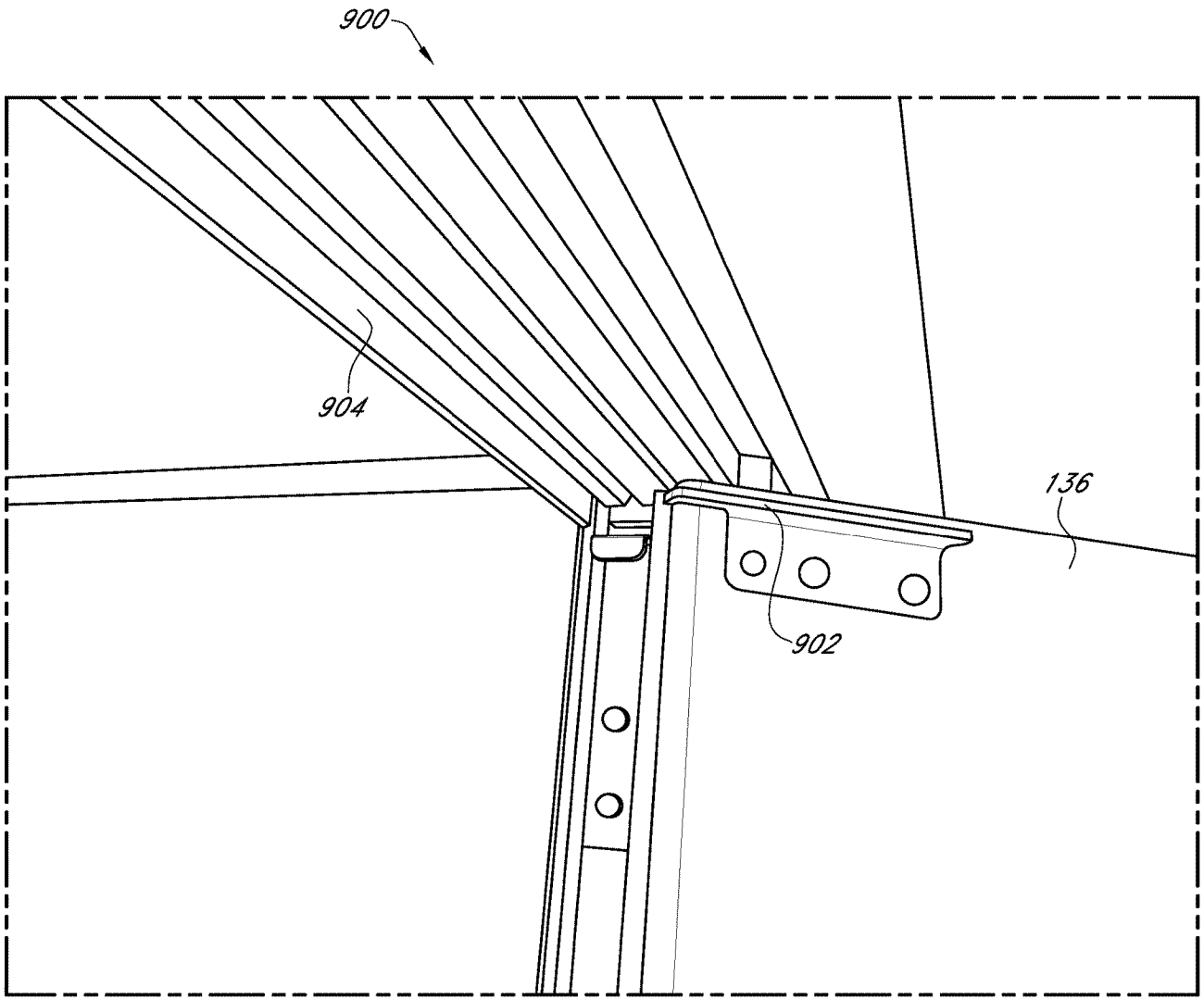
FIG. 9 is a perspective view of one embodiment of a tang mechanism positioned inside a storage receptacle.

FIG. 9 depicts a mechanism 900 that can cause the door 236 to open. A tang 902 can extend through the door into the structural portion of the locker system (not shown). The tang 902 can contact a leaf spring (not shown) disposed within the structural portion of the locker system. When the door 236 is shut, the tang 902 contacts and compresses the leaf spring. When the door is unlocked, as described elsewhere herein, the force of the leaf spring on the tang 902 causes the door to swing open. In some embodiments, the plunger mechanism 800 may not provide any door opening force, but may only be part of a detection circuit, and the door opening force can come only from the tang 902 and leaf spring. In some embodiments, the tang 902 can also or optionally be configured to prevent door from swinging open too far after being unlocked. The tang 902 is connected to the door 236. A strip 904 is positioned in the upper portion of the receptacle. The tang 902 catches on the strip 904 and limits the motion of the door 236. The user can pull on the door 236 to free the tang 902 from the strip 904 and further open the door. In some embodiments, the catching mechanism 900 may be located in another suitable portion the receptacle. In some embodiments, the tang 902 is connected to a retraction arm (not shown), which pulls the door shut, using a spring, pneumatic, or other force to close the door when the door is not actively being held open, for example, by a user.

The technology is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

The present disclosure refers to processor-implemented steps for processing information in the system. Instructions can be implemented in software, firmware or hardware and include any type of programmed step undertaken by components of the system.

The control unit, user interfaces, and/or the terminals can include one or more processors and may be implemented with any combination of general-purpose microprocessors, microcontrollers, digital signal processors (DSPs), field programmable gate arrays (FPGAs), programmable logic devices (PLDs), controllers, state machines, gated logic, discrete hardware components, dedicated hardware finite state machines, or any other suitable entities that may perform calculations or other manipulations of information. The central hub 120 may comprise a processor such as, for example, a microprocessor, such as a Pentium® processor, a Pentium® Pro processor, a 8051 processor, a MIPS® processor, a Power PC® processor, an Alpha® processor, a microcontroller, an Intel CORE i7®, i5®, or i3® processor, an AMD Phenom®, A-Series®, or FX® processor, or the like. The processor 111 typically has conventional address lines, conventional data lines, and one or more conventional control lines.

The system may be used in connection with various operating systems such as Linux®, UNIX®, MacOS®, or Microsoft Windows®.

The system control may be written in any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python or Ruby.

Those of skill will further recognize that the various illustrative logical blocks, modules, circuits, and algorithm steps described in connection with the embodiments disclosed herein may be implemented as electronic hardware, software stored on a computer readable medium and executable by a processor, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

If implemented in software, the functions may be stored on or transmitted over as one or more instructions or code on a computer-readable medium. The steps of a method or algorithm disclosed herein may be implemented in a processor-executable software module which may reside on a computer-readable medium. Memory Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A lock comprising:

a bolt movable along a first axis between a first locked position and a second unlocked position, the bolt having a first end and a second end;

a pin in mechanical communication with the bolt;

a slider movable along a second axis that is generally perpendicular to the first axis, the slider comprising a first end portion, a central portion, and a second end portion, and wherein the slider comprises an inclined surface that extends from the first end portion to the central portion;

an actuator connected to the slider that moves the slider along the second axis in response to a control signal; and wherein as the slider moves along the second axis, the inclined surface of the slider contacts the pin and the pin moves along the inclined surface of the slider, thereby moving the bolt from the first locked position to the second unlocked position.

2. The lock of claim 1, further comprising a spring, the spring disposed around an end of the bolt and in contact with the pin.

3. The lock of claim 2, wherein the spring is biased to urge the bolt into the first locked position.

4. The lock of claim 1, wherein the slider is connected to the actuator at the second end of the slider.

5. The lock of claim 1, wherein the slider comprises a first end and a second end and a central portion between the first and second ends, wherein the width of the slider at the first end and the second end are substantially the same width, and wherein the width of central portion of the slider is less than the width at the first end and the second end.

6. The lock of claim 5, wherein the width of the slider narrows from the first end to the central portion of the slider.

7. The lock of claim 5, wherein the central portion of the slider is disposed within the slot of the bolt.

8. The lock of claim 7, wherein the pin is configured to contact the slider along the narrowing width as the slider moves.

9. The lock of claim 1, wherein the second end of the bolt is tapered, and the second end of the bolt is configured to engage a securement feature.

10. The lock of claim 9, wherein the securement feature is disposed on a door configured to move to provide access to a lockable volume.

11. A locking system comprising:

a receptacle comprising by a plurality of surfaces and a door enclosing a lockable volume;

a lock disposed proximate one of the plurality of surfaces, the lock comprising:

a bolt movable along a first axis between a first locked position and a second unlocked position, the bolt having a first end and a second end the bolt having a slot formed therein;

a pin in mechanical communication with the bolt;

a slider movable along a second axis that is generally perpendicular to the first axis, the slider extending at least partially through the slot formed in the bolt;

an actuator connected to the slider that moves the slider along the second axis; and a door moveable to allow access to the lockable volume, the door comprising a securement feature configured to interact with the first end of the bolt to lock the door when the bolt is in a first locked position.

12. The locking system of claim 11, wherein the securement feature comprises an extending portion having a cutout formed therein, and wherein the first end of the bolt is received in the cutout formed in the extending portion when the bolt is in the first locked position.

13. The locking system of claim 11, further comprising a plunger mechanism disposed proximate one of the plurality of surfaces, the plunger mechanism comprising a rod and a spring, wherein the spring is biased to extend the rod.

14. The locking system of claim 13, wherein the rod is in contact with an inner surfaced of the door when the door is locked closed, and the spring is compressed when the door is locked closed.

15. The locking system of claim 14, wherein the spring is configured to urge the rod outward and push the door open when the door is unlocked.

16. A lock comprising:

a bolt movable along a first axis between a first locked position and a second unlocked position, the bolt having a first end and a second end, and the bolt having a slot formed therein, the slot extending along a portion of a length of the bolt between the first end and the second end of the bolt;

a pin in mechanical communication with the bolt;

a slider movable along a second axis that is generally perpendicular to the first axis, the slider configured to extend at least partially through the slot formed in the bolt;

an actuator connected to the slider that moves the slider along the second axis in response to a control signal; and wherein the slider is configured to contact the pin as the slider moves, thereby moving the bolt.

17. The lock of claim 16, wherein the slider comprises a first end and a second end and a central portion between the first and second ends, wherein the width of the slider at the first end and the second end are substantially the same width, and wherein the width of central portion of the slider is less than the width at the first end and the second end.

18. The lock of claim 17, wherein the width of the slider narrows from the first end to the central portion of the slider.

19. The lock of claim 17, wherein the central portion of the slider is disposed within the slot of the bolt.

20. The lock of claim 18, wherein the pin is configured to contact the slider along the narrowing width as the slider moves.

* * * * *